US009561634B2

(12) United States Patent
Kolbe et al.

(10) Patent No.: US 9,561,634 B2
(45) Date of Patent: Feb. 7, 2017

(54) SCRAPING DEVICE FOR A ROTARY TABLET PRESS, AS WELL AS A ROTOR AND ROTARY TABLET PRESS

(71) Applicant: Fette Compacting GmbH, Schwarzenbek (DE)

(72) Inventors: Sven Kolbe, Büchen (DE); Alexander Oldenburg, Schwarzenbek (DE)

(73) Assignee: Fette Compacting GmbH, Schwarzenbek (DE)

( * ) Notice: Subject to any disclaimer, the term of this patent is extended or adjusted under 35 U.S.C. 154(b) by 454 days.

(21) Appl. No.: 14/256,462

(22) Filed: Apr. 18, 2014

(65) Prior Publication Data

US 2014/0314895 A1 Oct. 23, 2014

(30) Foreign Application Priority Data

Apr. 23, 2013 (DE) ..... 10 2013 006 950

(51) Int. Cl.
*B30B 15/32* (2006.01)
*B30B 15/08* (2006.01)
*B30B 11/08* (2006.01)

(52) U.S. Cl.
CPC ..... *B30B 15/08* (2013.01); *B30B 11/08* (2013.01)

(58) Field of Classification Search
CPC ..... B30B 15/08; B30B 11/08
See application file for complete search history.

(56) References Cited

U.S. PATENT DOCUMENTS

| | | | | |
|---|---|---|---|---|
| 2,992,729 | A * | 7/1961 | Curtius | B30B 11/08 209/563 |
| 3,577,842 | A | 5/1971 | Nakai et al. | |
| 2006/0254438 | A1* | 11/2006 | Romer | B30B 15/32 100/144 |
| 2011/0001253 | A1* | 1/2011 | Isozumi | B30B 11/005 264/40.1 |

FOREIGN PATENT DOCUMENTS

| | | | |
|---|---|---|---|
| DE | 2264247 | | 7/1974 |
| EP | 1 470 908 | A2 | 10/2004 |
| EP | 2 551 099 | A2 | 1/2013 |
| GB | 1279950 | | 6/1972 |
| JP | H07241698 | A | 9/1995 |
| JP | 2000301391 | A | 10/2000 |
| WO | 88/00916 | | 2/1988 |

* cited by examiner

*Primary Examiner* — Joseph S. Del Sole
*Assistant Examiner* — John Robitaille
(74) *Attorney, Agent, or Firm* — Vidas Arrett & Steinkraus

(57) ABSTRACT

The invention relates to a scraping device for a rotary tablet press comprising a scraper that is designed to scrape off material for pressing that is located on the top side of a die plate of the rotary tablet press, the die plate rotating relative to the scraper, and comprising a force-generating apparatus that is designed to press the scraper with a predetermined compression against the top side of the die plate, characterized in that the force-generating apparatus comprises a fluid pillow filled with a fluid that is in contact with the scraper directly or via at least one transmission element in order to press the scraper by the predetermined compression against the top side of the die plate. The invention also relates to a rotor for a rotary tablet press, as well as a rotary tablet press.

8 Claims, 2 Drawing Sheets

Figure 1:
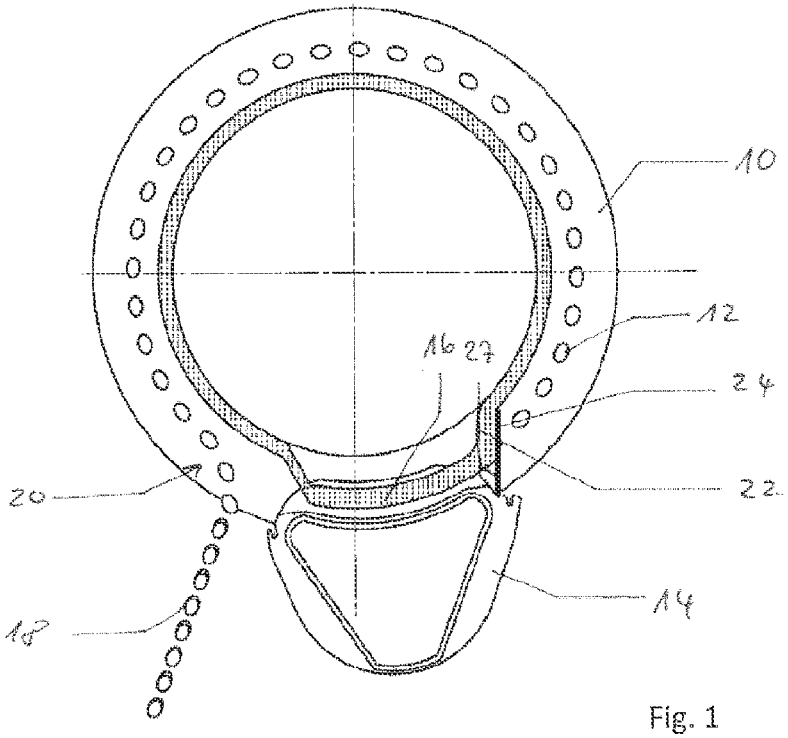

SCRAPING DEVICE FOR A ROTARY TABLET PRESS, AS WELL AS A ROTOR AND ROTARY TABLET PRESS

CROSS-REFERENCE TO RELATED APPLICATIONS

This application claims priority to DE Application No. 10 2013 006 950.5, filed on Apr. 23, 2013, the entire contents of which is incorporated herein by reference.

BACKGROUND OF THE INVENTION

The invention relates to a scraping device for a rotary tablet press comprising a scraper that is designed to scrape off material for pressing that is located on the top side of a die plate of the rotary tablet press, the die plate rotating relative to the scraper, and comprising a force-generating apparatus that is designed to press the scraper with a predetermined compression against the top side of the die plate. The invention also relates to a rotor for a rotary tablet press, as well as a rotary tablet press.

With rotary tablet presses, it is known to arrange scraping devices downstream from the filling apparatuses in order to scrape off from the die plate excess material for pressing. Known scraping devices have a scraper such as a so-called scraper blade that is pressed onto the top side of the die plate by means of a force-generating apparatus. Excess pressing material located on the die plate rotating under the scraper blade is then scraped off inward or outward by the scraper blade from the top side of the die plate. The material to be pressed can, for example, be a powder or pellets, or the like.

With known scraping devices, the scraper bar can be pressed onto the die plate by means of spring force. For this, the force-generating apparatus has a suitable spring. A disadvantage is that the spring force remains fixed due to the properties of the spring, especially its spring constant and its designed arrangement. It is only possible to adapt the spring force to different operating and/or installation situations with significant design effort. Furthermore, the compression from the use of a spring is not specifically defined when there are changes to the operating situation. For example, the scraper blade wears during operation which changes the compression against the top side of the die plate. The force-generating apparatus then must be manually adjusted. Such a manual adjustment or a change in the installation situation can lead to undefined changes in the compression.

On the basis of the presented prior art, the object of the invention is to provide a scraping device, a rotor and a rotary tablet press of the initially-cited type by means of which a specific scraper device compression exists at all times, wherein it is possible to easily flexibly adapt the scraping device to different operating situations and/or installations.

The invention achieves the object with a scraping device of the initially-cited type in that the force-generating apparatus comprises a fluid pillow filled with a fluid that is in contact with the scraper directly or via at least one transmission element in order to press the scraper by a predetermined compression against the top side of the die plate.

The scraper of the scraping device according to the invention can be a scraper blade. The scraper is arranged stationary in a known manner in the direction of rotation of the die plate behind the filling apparatus, also arranged in a stationary manner, for the rotary tablet press. The filling apparatus can in particular comprise a so-called filling shoe. The die plate with its die holes runs under the filling shoe, wherein the die holes are filled with the material for pressing such as a powder, or pellets, or the like. The scraper scrapes off excess material in a known manner that is on the top side of the die plate in the filling apparatus, at least out of the area of the pitch circle in which the die holes are arranged. At least one scraping edge of the scraper facing the excess material during operation is generally arranged at an angle relative to the radial direction with reference to the die plate. The scraper can completely scrape off the material from the die plate. It is however also possible to scrape off the material into an edge area of the die plate that is inactive during subsequent pressing. The excess material can be scraped off inward or outward in a known manner.

For scraping, the scraper is pressed by a force-generating apparatus onto the top side of the rotating die plate. According to the invention, the force-generating apparatus has a liquid pillow in which a fluid is under pressure. The fluid pillow presses the scraper directly or via at least one transmission element and thereby presses it against the top side of the die plate. The compression is generated by the fluid pressure predominating in the fluid pillow. In particular, the fluid pillow has an elastic case and expands according to the pressure predominating in the fluid pillow. This in turn leads to pressure being exerted on the scraper, or compression being exerted on the scraper. The scraper is in turn thereby pressed against the die plate. A constant compression is hence generated against the die plate independent of a level of wear of the scraper. In addition, by appropriately adjusting the fluid pressure predominating in the fluid pillow, a specific compression is generated in a particularly easy manner that can be flexibly adapted to different operating situations and/or installation situations.

It is possible in principle for the fluid pillow to be a liquid pillow filled with a liquid. According to one particularly practical embodiment, the fluid pillow can, however, be a gas pillow filled with a gas. In another particularly practical manner, the gas pillow can be an air pillow in which air is under pressure. The scraper is hence pressed pneumatically against the top side of the die plate.

According to one embodiment, the fluid pillow can be arranged in a housing, wherein the housing possesses at least one opening through which the fluid pillow is in contact with the scraper directly or by means of the at least one transmission element. The housing can, for example, consist of a metal material or plastic. Through the opening, there is a direct contact, or indirect contact via one or several transmission elements, between the fluid pillow and the scraper, whereby the scraper is pressed against the die plate. In particular, a side of the housing opposite at least one opening is closed. The corresponding housing wall that is substantially inflexible forms a counter-bearing against which the fluid pillow braces to exert the compression on the scraper. Almost any form is conceivable for the housing. The housing can for example be designed in the shape of a pot. It can for example possess the shape of a hollow cuboid closed on one side.

According to another embodiment, the force-generating apparatus can also comprise a fluid filling apparatus for filling the fluid pillow with a fluid such as gas. The fluid filling apparatus possesses in particular a control apparatus by means of which the level at which the fluid pillow filled with fluid can be controlled. As mentioned, the fluid pillow can be a gas or air pillow. The fluid pillow is then correspondingly filled with a gas or air by means of the fluid filling apparatus.

According to another embodiment, the force-generating apparatus can also comprise a pressure measuring apparatus that directly or indirectly measures the fluid pressure, such as the gas pressure, predominating in the fluid pillow. The fluid pressure predominating in the fluid pillow permits a direct inference of the pressure exerted by the fluid pillow on the scraper, and hence the compression with which the scraper is pressed against the top side of the die plate. It is therefore particularly easy to monitor the proper compression.

According to another embodiment, the force-generating apparatus can also comprise a fluid regulating apparatus that regulates the fluid filling apparatus to fill the fluid pillow with fluid such as gas depending on the measurements from the pressure measuring apparatus so that a specific fluid pressure predominates in the fluid pillow. By means of the fluid regulating apparatus, the fluid pressure in the fluid pillow, and hence the compression with which the scraper is pressed against the top side of the die plate, can be set to a constant value and maintained at this constant value. It is hence ensured that the scraper always presses against the top side of the die plate with a constant compression or constant pressure. The compression of the scraper is clearly specified at all times.

At the same time, it is possible in a particularly advantageous manner to regulate the fluid pressure in the fluid pillow to different values by means of the fluid control apparatus, i.e., for example to vary the fluid pressure depending on the purpose or place of use. On the one hand, it is therefore possible to adapt the scraping device in a particularly easy manner to different operating situations of the same rotary tablet press. On the other hand, it is possible to easily adapt the scraping device to different installation situations in the same rotary tablet press, or to use in different rotary tablet presses with different installation situations. This can ensure that the scraper always presses against the die plate with the desired compression, e.g. always with the same compression, even in different operating or installation situations, be it in the same or different rotary tablet presses.

As already mentioned, the invention also relates to a rotor for a rotary tablet press comprising a rotatably drivable die plate with a plurality of die holes, as well as an upper punch seat and a lower punch seat for the upper punch and lower punch of the rotary tablet press rotating with the die plate, and comprising at least one scraping device according to the invention.

As also already mentioned, the invention also relates to a rotary tablet press comprising a rotatably drivable die plate having a plurality of die holes, as well as an upper punch seat and a lower punch seat in which the upper punch and lower punch rotating with the die plate are guided to press material added to the die holes of at least one filling apparatus of the rotary tablet press arranged stationary relative to the die plate, wherein an upper punch and a lower punch are assigned in each case to a die hole, furthermore comprising a rotary drive for rotating the die plate as well as the upper die seat and the lower die seat, and furthermore comprising a scraping device according to the invention.

In a manner known per se, the rotary tablet press according to the invention comprises a pressing station with upper and/or lower compression rollers in which the material is pressed. Furthermore, the rotary tablet press comprises guide apparatuses, so-called guide cams, in a manner known per se for guiding the path of the upper and lower punch. In addition, the rotary tablet press comprises an ejection apparatus in a manner known per se that is also arranged stationary relative to the die plate and in which the pressed products such as tablets are ejected.

The at least one filling apparatus is arranged in a manner known per se in the direction of rotation of the die plate in front of the at least one scraper of the at least one scraping device such that material added to the at least one filling apparatus can be scraped off by the following scraper while the die plate rotates. The at least one pressing station of the rotary tablet press is correspondingly downstream from the scraper in the direction of rotation of the die plate in a manner known per se. If a plurality of filling apparatuses are provided, a plurality of scraping devices can correspondingly also be provided, wherein one scraping device is assigned to each filling apparatus. Correspondingly, a plurality of pressing stations assigned to the filling or scraping devices can also be provided. All of this is known and will therefore not be further explained.

BRIEF DESCRIPTION OF THE SEVERAL VIEWS OF THE DRAWING(S)

Figure 2:
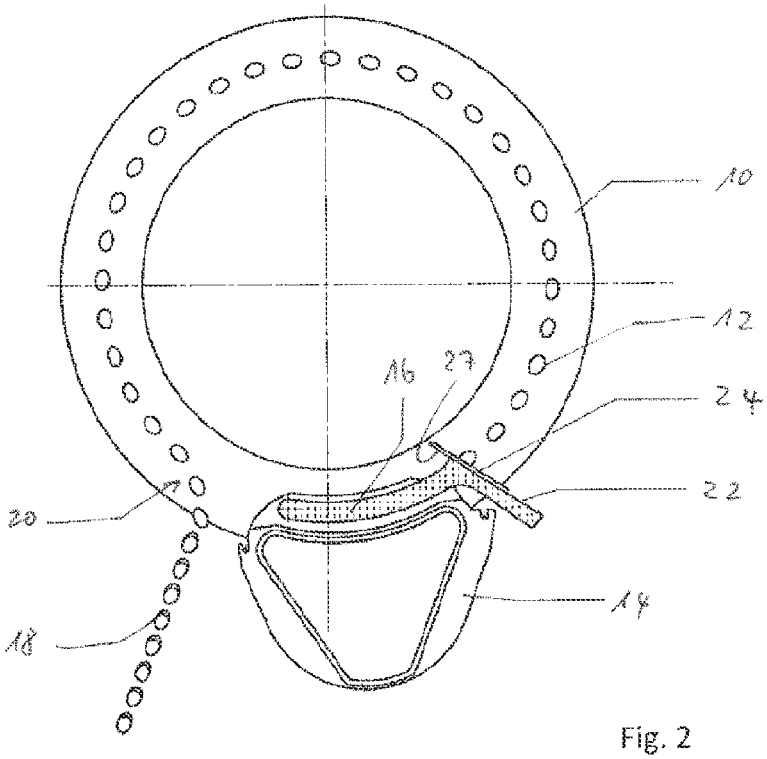
Figure 3:
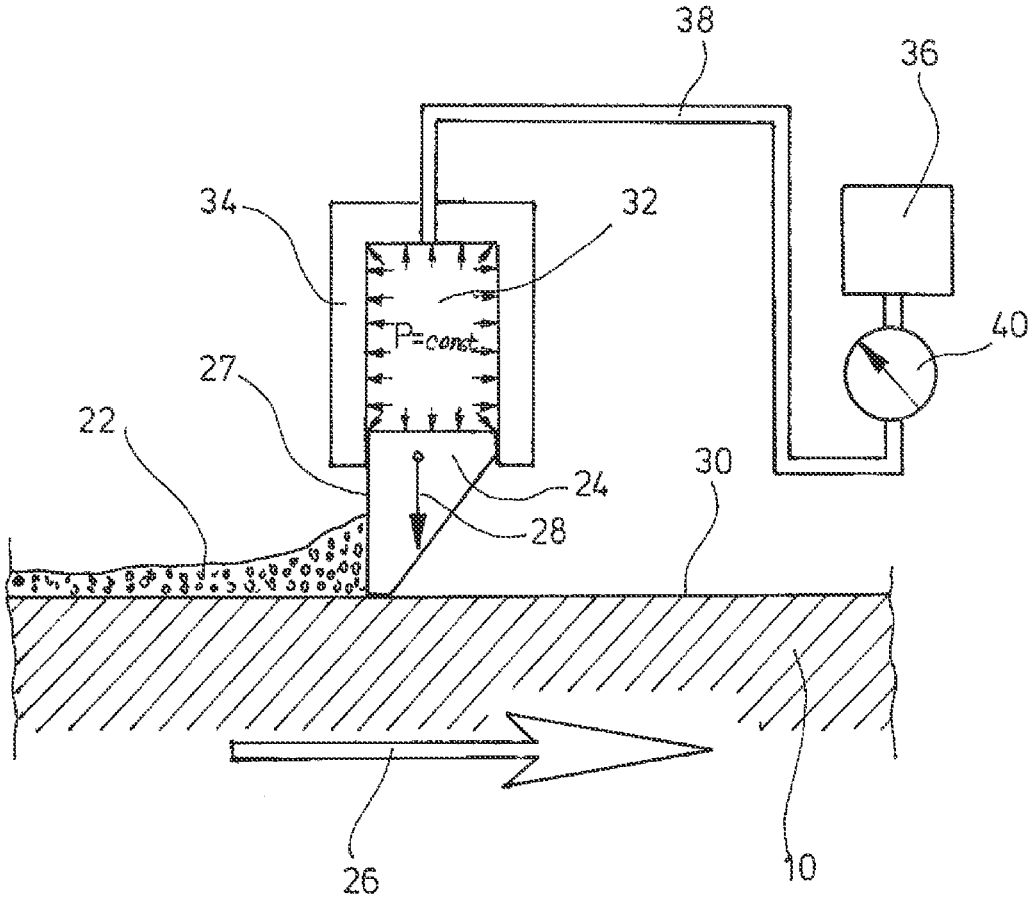

Exemplary embodiments of the invention are explained below in greater detail with reference to figures. They show schematically:

FIG. 1 A plan view of a part of a rotary tablet press according to the invention according to a first exemplary embodiment, FIG. 2 A plan view of a part of a rotary tablet press according to the invention according to a second exemplary embodiment, and FIG. 3 A sectional view of a scraping device according to the invention to be used in the rotary tablet press shown in FIG. 1 or in FIG. 2.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated If not otherwise specified, the same reference numbers indicate the same objects in the figures. The rotary tablet press partially depicted in FIG. 1 possesses an annular die plate 10 rotatably driven by means of a rotary drive (not shown) with a plurality of die holes 12 arranged on a pitch circle. The rotary tablet press furthermore possesses an upper punch seat (not shown) and a lower punch seat (also not shown) in which the upper and lower punch (not shown) are guided. The upper punch seat and the lower punch seat, and upper and lower punch along with them, are also driven by the rotary drive such that the upper and lower punch that are assigned in pairs to one die hole 12 rotate along with the die plate.

FIG. 1 also shows a filling apparatus with reference number 14 in which the material for pressing, such as a tablet powder 16, is added to the die holes 12. The filling apparatus 14 is arranged stationary such that the die plate 10 with its die holes 12 rotates under the filling apparatus 14 counter-clockwise in FIG. 1. The filling apparatus 14 is designed as a so-called filling shoe such that the die holes 12 are completely filled with the powder 16 for pressing in a manner known per se. Also in a manner also known per se, the filling apparatus 14 is downstream from a pressing station (not shown in FIG. 1) with upper and lower compression rollers in which the powder added to the die holes 12 is pressed by the upper and lower die. The finished tablets 18 are ejected from the rotary tablet press in an ejection apparatus 20.

Following the filling apparatus 14 in the direction of rotation of the die plate 10, excess tablet powder 22 collects that shall not be supplied to be pressed. To this end, a scraping device is provided of which only one scraper 24, in the present case a scraper bar 24, can be seen in FIG. 1. The scraper bar 24 is pressed against the top side of the die plate 10 in a manner that will be further explained below such that the excess powder 22 on the top side of the die plate 10 rotating under the scraper bar 24 in FIG. 1 is scraped off to the inside to an edge area of the die plate 10 that is inactive during pressing. The excess tablet power 24 can thereby be supplied to the filling apparatus 14 to be reused.

The design and function of the rotary tablet press, a section of which is depicted in FIG. 2, largely corresponds to the rotary tablet press depicted in FIG. 1. The rotary tablet press in FIG. 2 only differs from the rotary tablet press in FIG. 1 in regard to the arrangement of the scraper bar 24. The scraper bar 24 is arranged in FIG. 2 and is pressed against the top side of the die plate 10 such that the excess powder 22 in this exemplary embodiment is completely scraped off of the die plate 10 to the outside and downward.

The scraping device according to the invention will be further explained with reference to FIG. 3. It can be used both with a rotary tablet press from FIG. 1 as well as a rotary tablet press from FIG. 2. Reference number 10 in turn identifies a section of the die plate. The arrow 26 indicates the direction of rotation of the die plate. Reference number 24 indicates a section of the trapezoidal scraper bar. As illustrated by arrow 28, the scraper bar 24 is pressed with compression F against the top side 30 of the die plate 10. The scraper bar 24 forms a barrier for excess tablet powder 22 located on the die plate 10. Given the alignment that can be seen for example in FIGS. 1 and 2 of the scraping edge 27 of the scraper bar 24 facing the excess tablet powder 22 at an angle to the radial direction, the excess tablet powder 22 is scraped off of the die plate 10 rotating below the scraper bar 24.

The force-generating apparatus according to the invention that generates the compression 28 for the scraper bar 24 comprises a fluid pillow 32, in the present case a gas pillow 32, such as an air pillow 32, with a flexible case. The gas pillow 32 is arranged in a hollow cuboid housing 34, for example consisting of metal, that is open at its bottom side in FIG. 3. The gas pillow 32 is in contact with the scraper bar 24 through this opening. The end of the housing 34 opposite the opening is in contrast closed. It forms a counter-bearing for the gas pillow 32. A gas pressure predominates in the gas pillow 32, by means of which the scraper bar 24 is pressed with compression 28 against the top side 30 of the die plate 10. The force-generating apparatus according to the invention furthermore comprises a fluid regulating apparatus 36, in the present case a gas regulating apparatus 36, with an integrated fluid filling apparatus, in the present case a gas filling apparatus, including a control apparatus. The gas filling apparatus is connected via a gas line 38 to the interior of the gas pillow 32. The gas pillow 32 can be filled with gas by means of the gas filling apparatus. The force-generating apparatus furthermore comprises a pressure measuring apparatus 40 that measures the gas pressure predominating in the gas pillow 32 by measuring the gas pressure in the gas line 38. The gas regulating apparatus 36 controls the gas filling apparatus, and in particular its control apparatus, depending on the measurements from the pressure measuring apparatus 40 to fill the gas pillow with gas such that a predetermined constant gas pressure P predominates in the gas pillow 32. This constant gas pressure P ensures that the scraper bar 24 is pressed with a constant and specific compression 28 against the top side 30 of the die plate 10.

It is easily possible to adapt the gas pressure 32 and hence the compression 24 to different installation and/or operating situations of the scraping device according to the invention. The desired setpoint for the gas pressure P in the gas pillow 32 only needs to be specified for the gas regulating apparatus 36.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A scraping device for a rotary tablet press comprising a scraper (24) that is designed to scrape off material for pressing that is located on the top side (30) of a die plate (10) of the rotary tablet press, the die plate rotating relative to the scraper (24), and comprising a force-generating apparatus that is designed to press the scraper (24) with a predetermined compression against the top side (30) of the die plate (10), characterized in that the force-generating apparatus comprises a fluid pillow (32) filled with a fluid that is in contact with the scraper (24) directly or via at least one transmission element in order to press the scraper (24) with the predetermined compression against the top side (30) of the die plate (10).

2. The scraping device according to claim 1, characterized in that the fluid pillow is a gas pillow (32) filled with gas.

3. The scraping device according to claim 1, characterized in that the fluid pillow (32) can be arranged in a housing (34), wherein the housing (34) possesses at least one opening through which the fluid pillow (32) is in contact with the scraper (24) directly or by means of the at least one transmission element.

4. The scraping device according to claim 1, characterized in that the force-generating apparatus furthermore comprises a fluid filling apparatus for filling the fluid pillow (32) with fluid.

5. The scraping device according to claim 1, characterized in that the force-generating apparatus furthermore comprises a pressure measuring apparatus (40) that directly or indirectly measures the fluid pressure predominating in the fluid pillow (32).

6. The scraping device according to claim 4, characterized in that the force-generating apparatus can also comprise a fluid regulating apparatus (36) that regulates the fluid filling apparatus to fill the fluid pillow (32) with fluid depending on the measurements from the pressure measuring apparatus (40) so that a specific fluid pressure predominates in the fluid pillow (32).

7. A rotor for a rotary tablet press comprising a rotatably drivable die plate (10) having a plurality of die holes (12), as well as an upper punch seat and a lower punch seat for the upper punch and lower punch of the rotary tablet press that rotate with the die plate (10), and comprising at least one scraping device according to claim 1.

8. A rotary tablet press comprising a rotatably drivable die plate (10) having a plurality of die holes (12), as well as an upper punch seat and a lower punch seat in which the upper punch and lower punch rotating with the die plate (10) are guided to press material in the die holes (12) of at least one filling apparatus (14) of the rotary tablet press arranged stationary relative to the die plate (10), wherein an upper punch and a lower punch are assigned in each case to a die hole (12), furthermore comprising a rotary drive for rotating the die plate (10) as well as the upper die seat and the lower die seat, and furthermore comprising a at least one scraping device according to claim 1.

* * * * *